US005860415A

United States Patent [19]

Waters

[11] Patent Number: 5,860,415

[45] Date of Patent: Jan. 19, 1999

[54] PORTABLE GOLF BALL WARMING DEVICE

[76] Inventor: Richard Bryan Ransom Waters, 2146 Jeffrey Drive, Trenton, Ontario, Canada, K8V 5P8

[21] Appl. No.: 805,658

[22] Filed: Feb. 27, 1997

[51] Int. Cl.[6] ..... F24J 2/02

[52] U.S. Cl. ..... 126/680; 126/681; 126/657

[58] Field of Search ..... 126/651–654, 126/680, 681, 682, 569, 263.01, 657; 34/93

[56] References Cited

U.S. PATENT DOCUMENTS

| | | | |
|---|---|---|---|
| 2,272,340 | 2/1942 | Hampton . | |
| 3,497,676 | 2/1970 | Gravatt | 126/569 |
| 3,683,155 | 8/1972 | Loofbourow . | |
| 3,707,279 | 12/1972 | Kaiser . | |
| 3,720,197 | 3/1973 | Schroth | 126/681 |
| 3,831,001 | 8/1974 | Toomey et al. . | |
| 4,049,949 | 9/1977 | Fitzsimons . | |
| 4,098,019 | 7/1978 | Strong | 126/681 |
| 4,155,002 | 5/1979 | Cohen . | |
| 4,196,721 | 4/1980 | Posnansky | 126/680 |
| 4,262,660 | 4/1981 | Ilich | 126/682 |
| 4,420,681 | 12/1983 | Arnold . | |
| 4,545,362 | 10/1985 | Hendricks . | |
| 4,967,062 | 10/1990 | Cohen . | |
| 5,057,670 | 10/1991 | Cohen . | |
| 5,137,011 | 8/1992 | Roth . | |
| 5,460,160 | 10/1995 | Parrott . | |
| 5,676,128 | 10/1997 | Cowart | 126/681 |

FOREIGN PATENT DOCUMENTS

| | | | |
|---|---|---|---|
| 512526 | 1/1921 | France | 126/681 |
| 1332112 | 8/1987 | U.S.S.R. | 126/657 |

*Primary Examiner*—James C. Yeung

[57] ABSTRACT

A portable, solar powered golf ball warming device includes a hollow black tube as a warming chamber for golf balls. The black tube has separate elastomer loading and dispensing apertures disposed at opposite ends thereof. The black tube is disposed within a transparent housing which also supports a parabolic reflector shield. The parabolic reflector shield reflects solar energy to thereby warm the black tube. During sunny weather conditions, the device provides continuous heat to modern golf balls including those of two piece construction. The golf balls serially move within the warming device such that ambient air does not breach the warming chamber.

22 Claims, 3 Drawing Sheets

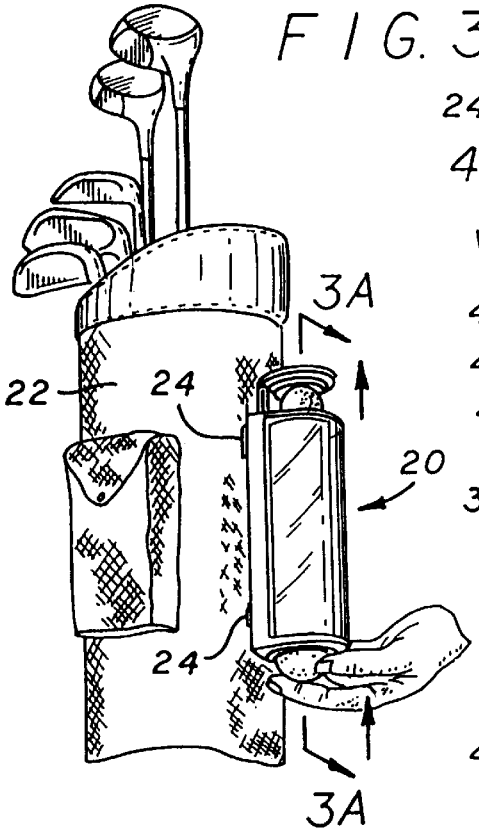
FIG. 1
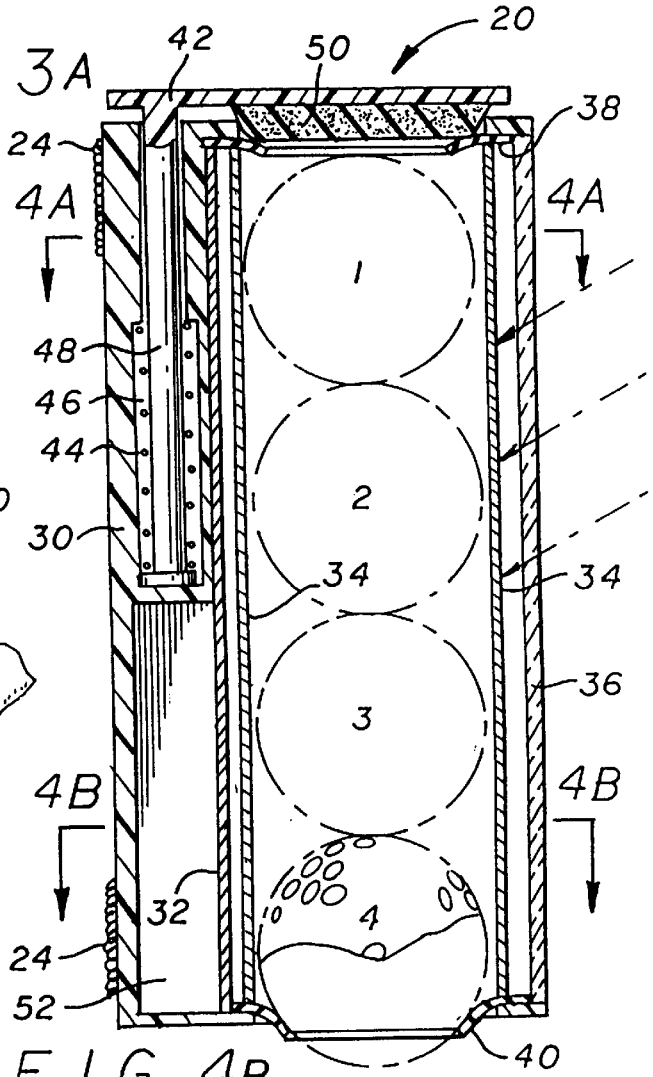
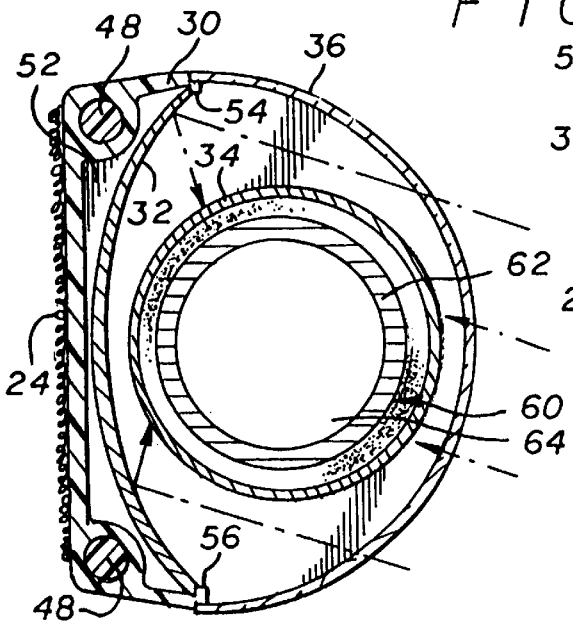
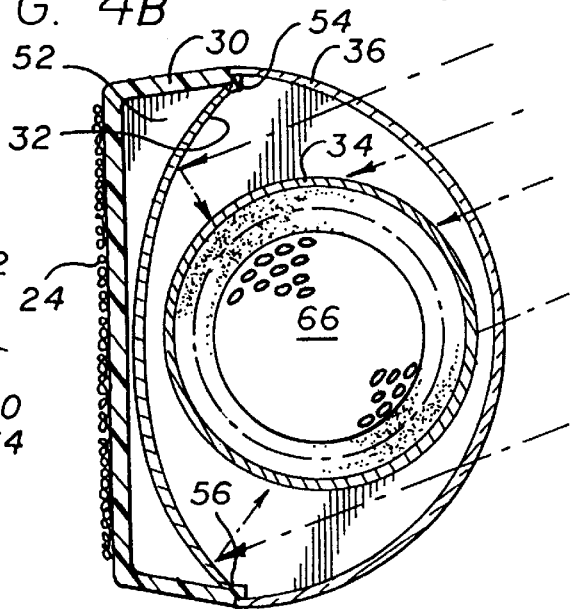

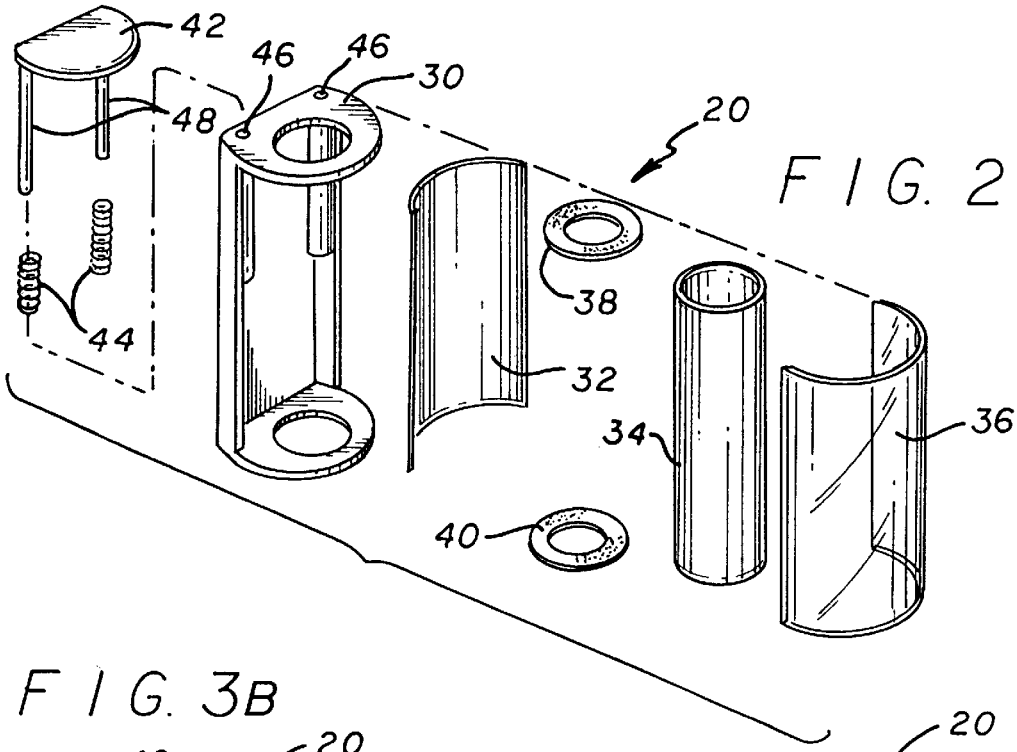
FIG. 2
FIG. 3B
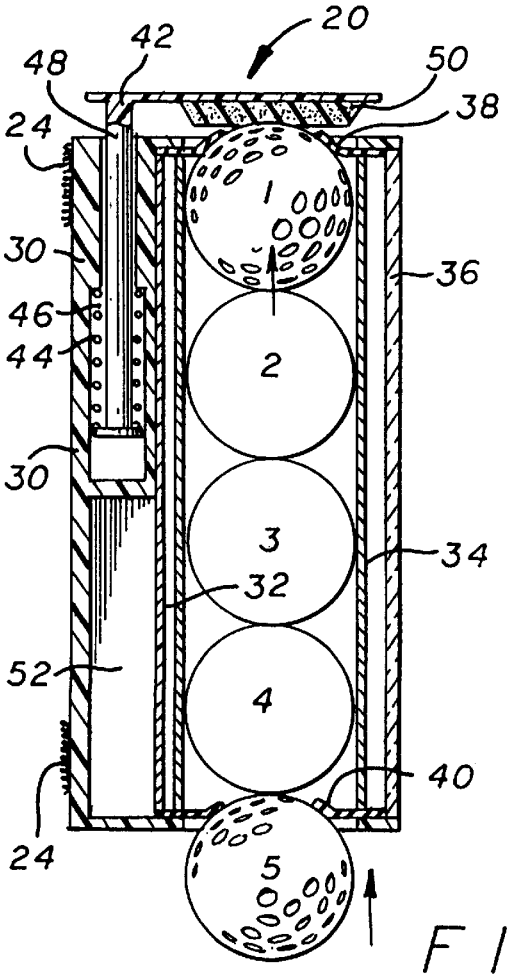
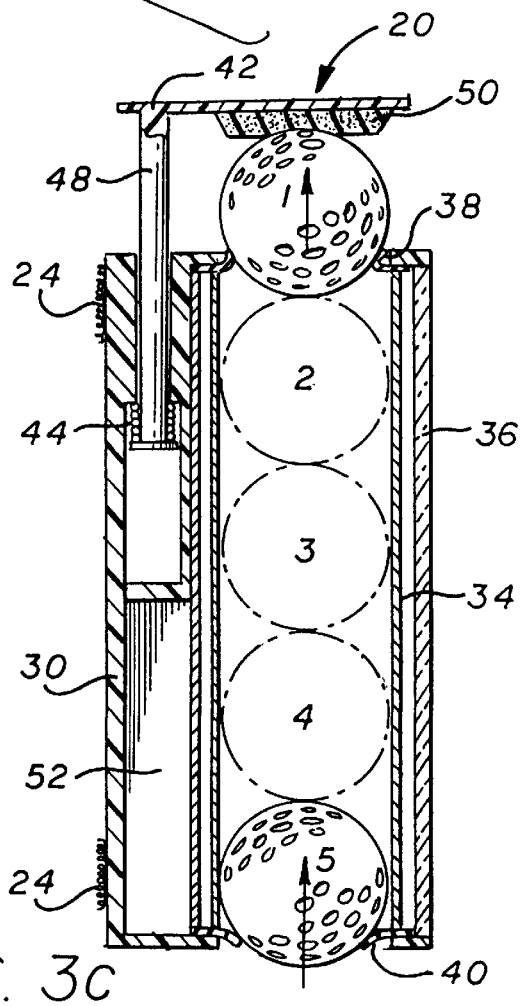
FIG. 3C

PORTABLE GOLF BALL WARMING DEVICE

BACKGROUND OF THE INVENTION

The present invention relates to the art of warming devices for warming golf balls. More particularly, the present invention relates to the art of portable warming devices for warming modern golf balls to improve performance characteristics during play.

The modern golf ball has undergone significant changes from its humble beginnings in the sixteenth century. In 1550, golf balls were made from wood and could travel a distance of up to 150 yards when struck. In the 1750s golf balls were made from leather, such as bull or horse hide, and stuffed with feathers. However, by 1850, golf balls were made in a one-piece construction from a rubbery substance known as "gutta percha."

By 1898, Coburn Haskell invented a "wound" golf ball which included a plurality of rubber strands wrapped around an interior core. By this time, golf balls were routinely being hit upwards of 200 yards. In 1921, the USGA (United States Golf Association) set a number of manufacturing criteria for golf balls including the requirement that no ball can weigh more than 1.62 ounces or be smaller than 1.62 inches in diameter.

Throughout the earlier part of this century, the USGA has frequently changed their criteria for golf ball construction and in 1942 adopted the initial velocity test to constrain the "liveliness" of golf balls to 250 feet per second, with a two percent tolerance. Since 1951, the USGA and the R&A (the Royal and Ancient Golf Club of St. Andrews, Scotland) have agreed upon golf standards including golf ball and golf club dimensions. In the 1950s most golf balls were made from a "three-piece" construction including an inner core (first piece), a plurality of windings (second piece), and a rubbery outer layer (third piece).

By the 1960s, "two-piece" golf balls became increasingly popular due to increased distance from 5-iron club lofts. However, the two-piece golf balls still met the USGA criteria for traveling a set distance at driver lofts.

Today, the USGA has adopted an indoor test for golf balls which simulates outdoor performance by propelling golf balls into a screen which is 70 feet from a launch position. Ball construction has likewise changed, and today golf balls are manufactured in the two-piece and three-piece, i.e. "wound" variety.

Three-piece golf balls, generally considered as superior by better golfers, have a liquid center or a solid center made from an elastic material such as polybutadiene. Three-piece golf balls are usually wound with a rubbery thread and covered with a form of rubber, i.e. polyisoprene. The most popular form of rubber for the outer coating of three-piece golf balls is "balata," which denotes the trans isomer form of polyisoprene. The cover material for golf balls generally has a hardness of 50 to 75 Shore D, and an icosahedron or modified cuboctahedron dimple pattern which generally covers upwards of 80% of the outer surface area. Often a plurality of different dimple types are simultaneously disposed on a golf ball surface to form the dimple pattern.

Modern two-piece golf balls generally have a tough outer coating of "surlyn" or a "surlyn/lithium" composite. This composite is more resistant to cutting and deformation than a balata cover and exhibits improved performance when heated to well above normal ambient temperatures.

The heating of golf balls improves performance without harmful effects or deterioration of the ball. When sufficiently heated, a modern golf ball will generally travel farther and feel "softer" when hit with a golf club. This farther travel and more comfortable feel allows for more enjoyable play, especially during cool weather.

The generally accepted rules of golf, i.e. the "Rules," are promulgated by the United States Golf Association and are incorporated herein by reference. The Rules specifically disallow the use of artificial equipment during specified play. More particularly, Rule 14-3 provides in pertinent part that " . . . during a stipulated round the player shall not use any artificial device or unusual equipment . . . which might assist him [or her] in making a stroke or . . . play."

Ever since golf balls have been manufactured from elastomer materials, a number of heat sources have been employed to warm golf balls and thereby enhance play. In fact, Walter Darden Hampton recognized that a portable golf ball heater may increase drive distance as early as 1942. Hampton, in U.S. Pat. No. 2,272,340, sets forth a chemically active heat pack which transmits heat to four golf balls disposed within a heat chamber. Hampton allows unidirectional upward movement of four golf balls within the heat chamber by way of insertion through cross-slit flaps. The cross-slit flaps are stiff and do not open under weight of the golf balls. However, undesirable ambient air enters the heat chamber during insertion and removal of the golf balls, and while the balls are at rest. Moreover, the chemical heating element only partially surrounds the heat chamber and a non-heated side of the heat chamber is not insulated against heat loss. Thus, golf balls stored within the heat chamber become heated unevenly.

Cohen, in U.S. Pat. Nos. 4,144,002, 4,967,062 and 5,057,670 sets forth a golf ball heating device which generates heat by electrical resistance from an external source. Cohen includes a divider which restricts movement of ambient air into the ball chamber during removal of a golf ball. However, the electrical resistance elements are an artificial means of heating golf balls and require a source of power. Cohen requires connection to an inconvenient electrical outlet or the use of batteries which must continually be replaced. Thus, Cohen does not meet the need for a portable golf ball warming device which does not require a source of power.

A number of prior disclosures suggest the use of chemically reactive heating composites as an alternative to electrical heat. For example, Roth, U.S. Pat. No. 5,137,011 and Parrott, U.S. Pat. No. 5,460,160 each use chemically reactive, disposable heating composites to supply continuous heat for approximately 4 to 6 hours. However, an inherent drawback of such devices is a constant need to replace the chemical heat pack. Hendricks, U.S. Pat. No. 4,545,362 includes a non-disposable, chemically reactive heat pack. However, the chemical heat pack of Hendricks is still considered artificial heat. Moreover, chemically reactive heat packs afford a maximum temperature of 127° Fahrenheit or less.

Many prior art devices require golf ball insertion and dispensing arrangements which are detrimental to the conservation of heat within a warming compartment. Such devices often sacrifice the economy of hand movement as well. For example, Parrott '011 discloses a staged warming pathway through which golf balls are unidirectionally moved from top to bottom, with a bottom ball captured in an insulated cap. The insulated cap is then removed to release a warmed golf ball. However, this configuration does not allow heated air to rise through the warming compartment and therefore subjects only the topmost, i.e. last inserted, ball to receive the highest temperatures within the device.

Furthermore, many prior devices set forth inconvenient means of ball insertion and removal. Often times, two separate removable end caps are provided which require the use of two hands for the separate actions of: top cap removal, ball insertion, top cap replacement, bottom cap removal, ball retrieval, and bottom cap replacement. Many prior devices also require a complex arrangement of different components which increase manufacturing and assembly costs.

Gravatt, U.S. Pat. No. 3,497,676 sets forth a golf ball warmer using a combination of solar energy and battery power. Gravatt provides a small and portable arrangement. However, when a cover/absorption plate assembly is opened to remove a golf ball, all of remaining balls are subjected to ambient air, thereby permitting considerable heat loss from the ball compartment. Moreover, additional ball compartments are necessary for storing multiple balls during an extended round of golf.

Schroth, U.S. Pat. No. 3,720,197 sets forth another solar design for a golf ball warmer. An absorber plate conducts solar heat energy to a golf ball compartment, but opens through a hinge which allows heated air to escape. While Schroth provides a D.C. battery backup system, the maximum temperature of the applied heat is limited to approximately 134° Fahrenheit. Moreover, clam-shell type absorption plates as used by Schroth necessitate that only one side of the golf balls receive the maximum generated heat. Consequently, the clam-shell type of solar golf ball warmers fail to warm golf balls in a symmetrical manner so as to ensure even heating throughout.

In view of the above, a need exists for a golf ball warming device which is self-contained, and provides a sufficient quantity of warmed golf balls throughout an extended round of play without dependence upon any artificial source of heat energy.

A further need exists for a golf ball warming device which facilitates simple and economic hand movement when loading and dispensing golf balls, and maintains heat within a golf ball warming chamber while denying exposure of the warmed golf balls to ambient air until required.

An additional need exists for a golf ball warming device which is simple in design, portable, and provides for higher temperatures as required to impart greater benefits to a modern golf ball having a two-piece construction.

SUMMARY OF THE INVENTION

It is therefore an object of the present invention to provide a golf ball warming device which is self-contained, provides a sufficient quantity of warmed golf balls for an extended round of golf, and requires only naturally occurring sunlight as a source of heat energy.

It is also an object of the present invention to provide a golf ball warming device which allows for simple and convenient insertion and removal of golf balls while maintaining heat within a ball warming chamber and while preventing the exposure of warmed golf balls to ambient air until required for use.

It is a further object of the present invention to provide a golf ball warming device which is simple in design, portable in weight and size, and capable of providing a measure of heat which is proportionate for and tolerated by modern golf balls of two-piece construction.

The present invention achieves these objects as well as other objects and advantages by providing a solar golf ball warmer having a substantially cylindrical body, of which approximately one half is a convex and transparent cover. Within the body is a circular thin walled tube having an exterior which is substantially a flat black color and which serves as a solar collector. Each end of the thin walled tube supports separate loading and dispensing apertures. When bonded together, these components form a hermetically sealed greenhouse-like structure, with a black collector tube providing for a linear, staged, warming pathway for heating a plurality of standard size golf balls. Solar rays penetrate the transparent cover and are received with a black collector tube. The black tube converts the solar rays to heat energy which is then absorbed by the golf balls.

Fixed within the body and adjacent and parallel to the collector tube, is a convex reflector forming a parabolic trough of equal length to the collector. The convex reflector serves to redirect any solar rays not immediately impacting upon the collector, and to reflect any radiant heat emanating from the collector tube toward the back and sides of the collector tube itself, thereby increasing thermal efficiency. Further reduction in heat loss is provided by an insulating material which is placed between the reflector and a base housing. Preferably, the device will operate at maximum efficiency when fully loaded with golf balls. Moreover, the present invention should be used in maximum sunlight to mild overcast conditions to achieve an optimum warming effect.

Overall heat absorption efficiency of the device is a function of the cross-sectional width of the transparent cover and reflector shield. Exposure of the internal golf balls to available solar rays increases in proportion to the cross-sectional width. As the distance between the outer radius of the collector tube and a point where the cover and reflector converge increases, so does the capacity for the reflector to redirect non-incident solar energy toward the back and sides of the collector tube.

An important object of the present invention is to warm golf balls well above ambient temperatures to enhance drive distance and to provide a softer feel when struck. It is a further object of the invention to significantly warm golf balls above 150° Fahrenheit and up to 180° Fahrenheit.

According to a preferred embodiment of the present invention, the base of the device is affixed to a pull-type or motorized golf cart. When in normal use, its longitudinal axis is oriented toward the sky approximately 45 to 60 degrees from a vertical position. This provides optimal exposure to available solar radiation. Attachment to a cart may be permanent or with some other means such as VELCRO hook-and-loop type material. Maximum exposure to direct sunlight is easily maintained during play due to the curved shape of the transparent cover, which allows for the uninterrupted passage of solar rays from a wide angle without requiring that the player constantly aim the device at the sun.

The loading aperture is similar to a rubber washer and is placed at a bottom end of the device. The loading aperture is preferably constructed of a thin elastomer sheet material and forms a disc having a centered hole of a diameter somewhat less than a standard size golf ball. When a golf ball is inserted through the hole in an upward fashion, equal force is placed on the inner radius of the elastomer material, which is then stretched to allow for passage of the golf ball. The frictional and intimate contact between ball and elastomer affords a means by which the balls may travel freely through the aperture while simultaneously denying entry of cooler ambient air. In effect, the bottom golf ball cooperates with the device, acting as a plug to support the balls above and preventing the entry of ambient air. This also precludes the need for a bottom cap or similar device.

The dispensing aperture is located at a top end of the device and includes an elastomer material working in concert with a return-spring loaded insulated cap. The conveyance of golf balls is then allowed to proceed in an unobstructed and serial manner throughout an extended round of golf, while affording a maximum retention of heat within the collector tube and economy of hand movement. This arrangement also provides for the a constrained retention of golf balls within a collector tube. Only a small portion of the lowest, last entered golf ball is exposed to ambient air while the other balls, in serial fashion, ascend through an increasingly heated pathway.

Due to the nature of heated air to rise through convection current, any heat energy converted by the collector will tend to stratify within the warming pathway. The result of this configuration is that the topmost ball within the collector, which is the ball to be next and instantly required during play, is subject to the maximum temperature afforded by the device and thus supports the objective of thermal efficiency. Moreover, when golf balls are at rest within the collector, their combined weight exerts sufficient downward force upon the bottom elastomer aperture, so as to create an air tight seal between the bottom aperture and the lowermost golf ball, thereby denying entry of ambient air into the collector tube during all stages of golf ball movement through the device.

The aforementioned and other objects, features, and advantages of the present invention will become readily apparent from the following description of the preferred embodiment(s), as well as from the associated drawings, all of which merely illustrate the inventive concept, and are not in any way intended, nor should they be construed, to limit the scope of the instant invention.

BRIEF DESCRIPTION OF THE DRAWINGS

FIG. 1 is a perspective view of a portable golf ball warming device in use according to a preferred embodiment of the present invention.

FIG. 2 is an exploded perspective view illustrating a number of internal components of a portable golf ball warming device according to a preferred embodiment of the present invention.

FIGS. 3A–3C are a series of sectional views of a golf ball warming device taken along line 3—3 of FIG. 1 and illustrating insertion and removal of golf balls during operation.

FIGS. 4A and 4B are sectional views taken respectively along lines 4A—4A and 4B—4B of FIG. 3A.

DETAILED DESCRIPTION OF THE PREFERRED EMBODIMENTS

Figure 5:
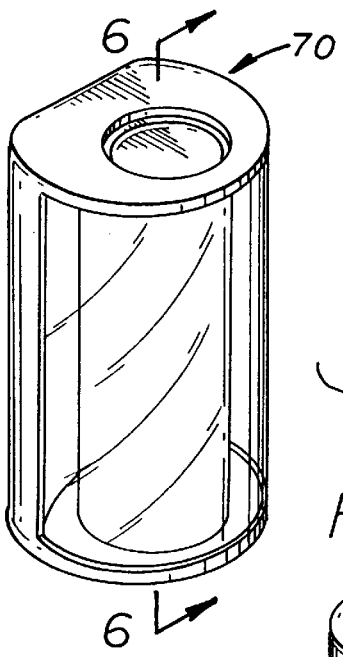
FIG. 5 is an elevated perspective view of a golf ball warming device according to a second embodiment of the present invention.

With reference now to the drawings and more particularly to FIG. 1, a portable golf ball warming device 20 is illustrated and described. Golf ball warming device 20 is configured and arranged for attachment to a carrying member such as golf bag 22. Golf ball warming device 20 is preferably disposed in a longitudinal direction with respect to golf bag 22 and may be permanently or removably affixed thereto. As illustrated, golf ball warming device 20 is affixed to golf bag 22 by a plurality of fastener tabs 24. Fastener tabs 24 are preferably hook and loop type fasteners such as those sold under the trademark VELCRO. As illustrated by the direction arrows of FIG. 1, golf balls are inserted into the bottom of warming device 20 and removed from the top thereof. Preferably, warming device 20 is attached to golf bag 22 or a golf cart (not shown) at an appropriate angle of approximately 45 to 60 degrees from vertical to allow for maximum exposure to available solar energy from a wide angle of incidence, such as would naturally occur when golf bag 22 is rested on a pull type golf cart (not shown).

Turning now to FIG. 2, an exploded perspective view of golf ball warming device 20 is illustrated and described. Warming device 20 includes base 30 which is preferably made from polycarbonate plastic and is opaque in color. Base 30 supports parabolic trough reflector 32, collector tube 34, and transparent cover 36. Base 30 also provides support for a number of golf ball containment members including top aperture 38 and bottom aperture 40 through which the golf balls pass. Top end cap 42 is slidably received within base 30 and forms an airtight barrier therewith. Top end cap 42 is urged into a closed position with respect to base 30 by way of resilient compression members 44.

Base 30 includes a pair of guide holes 46 which are recessed from the top side thereof. Guide holes 46 are preferably cylindrical, however any tubular shape will suffice. Guide holes 46 each include an enlarged portion which is configured and arranged to received a corresponding compression member 44 from top end cap 42. Compression members 44 are respectively connected to a corresponding guide rod 48 which extends downwardly from top end cap 42. Compression members 44 urge top end cap 42 into a closed position to seal collector tube 34 from ambient air.

Transparent cover 36 is preferably made from polycarbonate plastic or acrylic. Cover 36 is permanently bonded to base 30 to thereby form a roughly open tubular container and collectively define a main body. Base 30 supports top dispensing aperture 38 and bottom dispensing aperture 40 which are preferably made from an elastomer material which stretches under pressure. Collector tube 34 is also supported by base 30 and is preferably a hollow, cylindrical, aluminum tube. Collector tube 34 preferably has a light absorbing color such as black.

Parabolic trough reflector 32 is preferably a convex mirror shield made from a reflective material such as polished metal, or a reflective plastic film. The orientation of reflector 32 reflects solar radiation toward collector tube 34 and also redirects radiant heat emanating from collector tube 34 back toward collector tube 34. Reflector 32 is preferably described by a line approximately 4.5 to 5.5 inches in radius. Turning now to FIGS. 4A and 4B, reflector 32 is preferably capable of forming the above shape when forced into the allotted space between contact points 54 and 56. Contact points 54 and 56 are also bonding points for base 30 and cover 36. This preferred method of friction fitting eliminates the requirement for any mechanical means of adhering base 30 to reflector 32 and also reduces the need for costly pre-forming of parts. Thus, reflector 32 may be cut to size from available material in the marketplace.

Together, base 30, reflector 32, top dispensing aperture 38, bottom dispensing aperture 40, collector tube 34 and transparent cover 36 are bonded with an adhesive to thereby define a hermetically sealed and hollow structure. An unobstructed pathway is formed along an internal longitudinal axis of collector tube 34 to receive a plurality of standard sized golf balls.

As illustrated in FIG. 3A, top end cap 42 includes an insulation section 50 which is compressibly received within the top end of collector tube 34 to form an air tight barrier. As illustrated in FIG. 3A, insulation barrier 52 (optional) may be disposed within a space between base 30 and reflector 32. According to another embodiment of the present invention, insulation barrier 52 extends lengthwise within a space between base 30 and reflector 32 to retain heated air within warming device 20. The space between collector tube 34 and transparent cover 36 is preferably filled with air. The air is preferably sealed within warming device 20 and separate from the air within collector tube 34. Thus, the air between collector tube 34 and cover 36 retains the heat output from collector tube 34 during use.

FIGS. 3A, 3B and 3C illustrate operation of the preferred embodiment of the present invention. FIG. 3A illustrates a configuration of the invention in which four golf balls are being warmed by solar radiation. In FIGS. 3B–3C, golf ball 5 is inserted into the bottom of warming device 20 and golf ball 1 is ejected therefrom. As golf ball 5 is inserted into collector tube 34, the spring loaded top end cap 42 is urged upwardly against the force of compression members 44. After golf ball 1 is removed from warming device 20, compression members 44 urge top end cap 42 into the closed position.

Top dispensing aperture 38 and bottom dispensing aperture 40 are preferably made from an elastomer compound such as inner tube rubber. The material may be either pre-formed or cut from sheet shock. The apertures take on the appearance of common rubber and have a material thickness suitable for repetitive use. The apertures are respectively bonded to the upper and lower sides of base 30 by a suitable adhesive. The apertures are each formed with a centered circular hole having a diameter which is less than a standard sized golf ball. The diameter resists the passage of a golf ball such that the elastomer material is stretched evenly around the golf ball without tearing or deforming. The actual diameter of the hole size will vary depending upon material thickness and constitution.

During operation of the preferred embodiment of the present invention, golf balls may be serially loaded into golf ball warming device 20 without allowing the passage of cooler ambient air. As illustrated particularly in FIG. 3C, the golf balls exert enough downward force on the bottom ball to create an air tight seal with bottom dispensing aperture 40. Through this arrangement, the lowermost golf ball cooperates with the golf ball warming device to eliminate the costly need for a further apparatus at the loading end to retain warm air within the device. As an additional feature, this arrangement facilitates manual operation of the device with a single hand, thus freeing the golfer's other hand for other tasks.

Through experimental testing of an embodiment of the present invention, golf balls have been warmed significantly above 150° Fahrenheit. In fact, according to a preferred embodiment of the present invention, golf balls are warmed to a temperature exceeding 180° Fahrenheit.

According to a second embodiment (not shown), the invention includes multiple collector tubes, convex reflectors, and an appropriate association of attaching components, so as to provide for a solar golf ball warmer of larger proportion and golf ball capacity for use on occasion where mobility is not of primary concern, such as on a golf course practice tee or for demonstration purposes. Collectively, such an embodiment would not substantially deviate from the basic configuration of components described herein, and their interactive relationship with respect to the efficient collection, reflection, absorption, and conservation of solar energy for the purpose of warming golf balls. Such an embodiment also allows for economic and efficient serial movement of golf balls through the device.

Turning now to FIGS. 4A and 4B, sectional views taken along respective lines of FIG. 3A are illustrated. FIG. 4A illustrates a cross section through a modern two-piece golf ball 60. Golf ball 60 includes a solid inner core 64 which is preferably made from an elastomeric material. Golf ball 60 also has a cover material 62 made from a rubber material such as surlyn. FIG. 4B illustrates golf ball 66 which is a lowermost ball within golf ball warming device 20.

Figure 7:
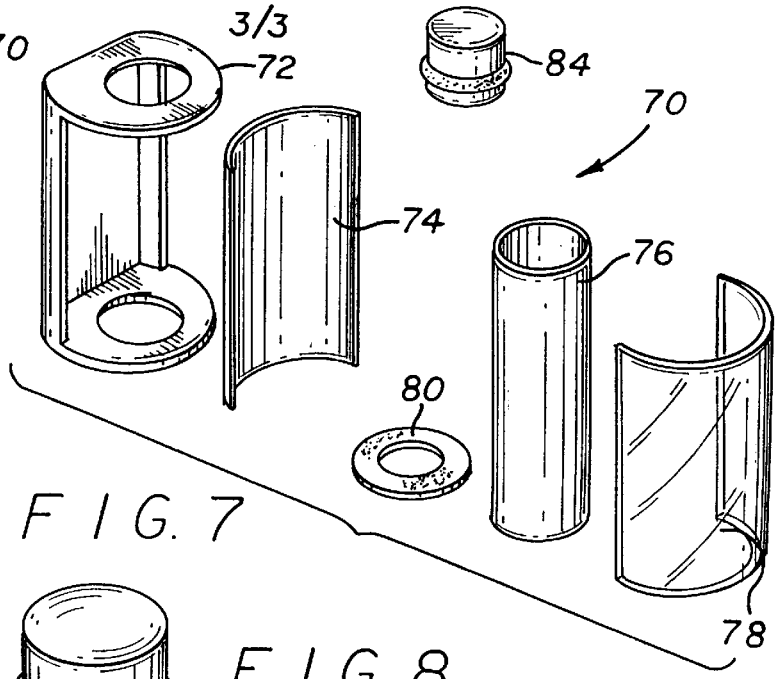
FIG. 7 is an exploded perspective view of the golf ball warming device of FIG. 5.
Figure 8:
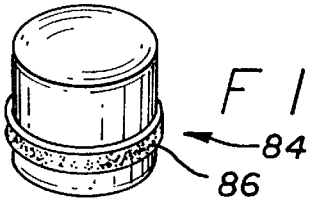
FIG. 8 is a perspective view of a cap for the golf ball warming device of FIG. 5.
Figure 6:
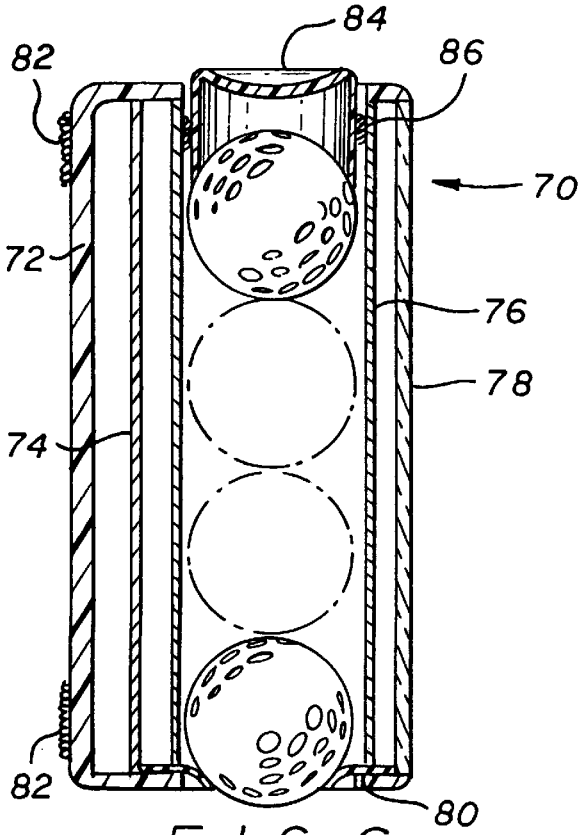
FIG. 6 is a sectional view of the golf ball warming device of FIG. 5.

FIGS. 5–8 illustrate a third embodiment of the present invention. As illustrated in FIGS. 5–8, golf ball warming device 70 is similar to the preferred embodiment of FIG. 1. Golf ball warming device 70 includes a base 72, parabolic reflector 74, collector tube 76, transparent cover 78 and bottom dispensing aperture 80. Golf ball warming device 70 is preferably affixed to a golf bag or a golf cart by way of fastener tabs 82. However, according to this embodiment, the top of warming device 70 is secured with top end cap 84. Top end cap 84 is more particularly illustrated in FIG. 8 and is preferably in the form of a plastic hollow cup. Top end cap 84 is configured to be received within the top end of collector tube 76. Top end cap 84 includes a felt band 86 which encircles an outer periphery thereof. Felt band 86 forms an air tight barrier with the interior perimeter of collector tube 76 to retain warm air therein. Felt band 86 may be made from another suitable material which has a low coefficient of friction and retards the passage of air. Top end cap 84 includes insulation (not shown) which helps to maintain the warm air within the device.

The foregoing is considered as illustrative only of the principles of the invention, and since numerous modifications and changes will readily occur to those skilled in the art, it is not desired to limit the invention to the exact construction and operation shown and described, and accordingly, all suitable modifications and equivalents may be resorted to, falling within the scope of the following claims.

I claim:

1. A device for warming golf balls, comprising:

a base bonded to a curved transparent cover to define a hollow housing; and a cylindrical tube having a solar energy absorbing color disposed within the housing and forming a warming pathway for receiving golf balls, said tube having a loading aperture disposed at a first end for loading the golf balls and a dispensing aperture disposed at a second end for dispensing the golf balls, wherein said loading aperture is an elastomer disposed at a bottom side of said cylindrical tube to restrict downward movement of the golf balls and form an intimate air tight seal with the lowermost golf ball, whereby solar energy passes through said transparent cover, warms said tube and warms the golf balls.

2. The device for warming golf balls according to claim 1, wherein said loading aperture has a flexible circular orifice, through which standard sized golf balls may pass in serial fashion while denying the intrusion of ambient air into the cylindrical tube through intimate frictional contact, and an uppermost golf ball is ejected from the device when the device is fully loaded with golf balls and a new golf ball is loaded into the device.

3. The device for warming golf balls according to claim 1, further comprising:

a top end cap which is slidably received within the housing to form an air tight barrier over the dispensing aperture.

4. The device for warming golf balls according to claim 3, wherein the top end cap is urged into a closed position with respect to the dispensing aperture by a resilient compression member.

5. The device for warming golf balls according to claim 1, further comprising:

a reflector disposed within the housing between said base and said cylindrical tube, wherein said reflector reflects solar radiation received through said transparent cover toward said collector tube.

6. The device for warming golf balls according to claim 1, wherein said cylindrical tube is flat black.

7. The device for warming golf balls according to claim 1, wherein said device does not heat the golf balls with an electrical resistance heating element and said device does not heat the golf balls with a chemically reactive heating element.

8. A device for warming golf balls, comprising:

a transparent tubular housing;

a tube disposed within said housing, said tube configured to receive and retain golf balls in a substantially linear fashion through a loading aperture having a flexible circular orifice and disposed at a first end of said tube, through which standard sized golf balls may pass in serial fashion while denying the intrusion of ambient air into said tube through intimate frictional contact, such that an uppermost golf ball is ejected from the device when the device is fully loaded with golf balls and a new golf ball is loaded into the device; and a reflector disposed within said housing to reflect solar energy to said tube, whereby solar energy passes through said housing and warms said tube.

9. The device for warming golf balls according to claim 8, wherein said reflector is a parabolic reflector which reflects heat emitted from said tube toward said tube.

10. The device for warming golf balls according to claim 8, wherein said tube is flat black.

11. The device for warming golf balls according to claim 8, wherein said device does not heat the golf balls with an electrical resistance heating element and said device does not heat the golf balls with a chemically reactive heating element.

12. The device for warming golf balls according to claim 8, wherein said device heats golf balls over 150° Fahrenheit when fully loaded with multiple golf balls and exposed to direct sunlight.

13. The device for warming golf balls according to claim 8, wherein a sealed air pocket is formed between said housing and said tube such that air within said sealed air pocket is warmed from heat emitted from said tube and forms an insulating barrier from the external environment.

14. The device for warming golf balls according to claim 8, further comprising:

a flexibly deformable dispensing aperture disposed at a second end of said tube for dispensing the golf balls, whereby when said tube is fully loaded with golf balls and a golf ball is introduced through said loading aperture, a top golf ball within said tube is ejected out of said dispensing aperture.

15. The device for warming golf balls according to claim 14, wherein said loading aperture is an elastomer.

16. The device for warming golf balls according to claim 8, further comprising:

a top end cap having a peripheral band which is slidably received within said housing to form an air tight barrier over said loading aperture.

17. The device for warming golf balls according to claim 16, wherein the top end cap is urged into a closed position with respect to said loading aperture by a resilient compression member.

18. A device for warming golf balls, comprising:

a tubular housing formed from an opaque base member and a transparent cover member;

a solar energy collector tube disposed within said housing and configured to receive golf balls;

a reflector disposed within said housing to reflect solar energy transmitted through said transparent cover member to said collector tube, whereby solar energy warms said collector tube;

an elastomeric loading aperture disposed at a first end of said collector tube for loading the golf balls therein;

an elastomeric dispensing aperture disposed at a second end of said collector tube for dispensing the golf balls, whereby as a golf ball is introduced through said loading aperture into a fully loaded collector tube, a top golf ball within said tube is ejected out of said dispensing aperture.

19. The device for warming golf balls according to claim 18, wherein said collector tube is flat black and a sealed air pocket is formed between said housing and said collector tube, wherein said device does not heat the golf balls with an electrical resistance heating element and said device does not heat the golf balls with a chemically reactive heating element.

20. A device for warming golf balls, comprising:

a transparent tubular housing;

a tube disposed within said housing and configured to receive golf balls;

a reflector disposed within said housing to reflect solar energy to said tube, whereby solar energy passes through said housing and warms said tube;

a loading aperture disposed at a first end of said tube for loading the golf balls therein; and a dispensing aperture disposed at a second end of said tube for dispensing the golf balls, whereby when said tube is fully loaded with golf balls and a golf ball is introduced through said loading aperture, a top golf ball within said tube is ejected out of said dispensing aperture.

21. The device for warming golf balls according to claim 20, wherein said loading aperture is an elastomer disposed at a bottom side of said tube to restrict downward movement of the golf balls and form an air tight seal between a lowermost golf ball and said tube.

22. A device for warming golf balls, comprising:

a transparent tubular housing;

a tube having a dispensing aperture, disposed within said housing and configured to receive golf balls;

a reflector disposed within said housing to reflect solar energy to said tube, whereby solar energy passes through said housing and warms said tube; and a top end cap which is slidably received within said housing to form an air tight barrier over the dispensing aperture, wherein the top end cap is urged into a closed position with respect to said dispensing aperture by a resilient compression member.

* * * * *